United States Patent [19]

Frederick

[11] 4,377,055

[45] Mar. 22, 1983

[54] SEALING FRAME FOR USE IN WINDOW CASE

[76] Inventor: George L. Frederick, 1808 Juno Ave., Ottawa, Ontario, Canada, K1H 6S7

[21] Appl. No.: 251,938

[22] Filed: Apr. 7, 1981

[30] Foreign Application Priority Data

Jan. 21, 1981 [CA] Canada ..... 368980

[51] Int. Cl.[3] ..... E05D 7/08

[52] U.S. Cl. ..... 49/388; 49/67; 49/465; 49/488

[58] Field of Search ..... 49/465, 466, 488, 67, 49/501, 388, 394

[56] References Cited

U.S. PATENT DOCUMENTS

| | | | |
|---|---|---|---|
| 2,812,557 | 11/1957 | Hauck | 49/394 X |
| 3,331,161 | 7/1967 | Ruff | 49/394 X |
| 3,778,932 | 12/1973 | Ewing | 49/388 |

*Primary Examiner*—Philip C. Kannan

*Attorney, Agent, or Firm*—Dressler, Goldsmith, Shore, Sutker & Milnamow, Ltd.

[57] ABSTRACT

A frame particularly for use in a supplemental window which may be installed in an existing window case comprising sections of a linear extrusion forming a rigid body. The elements including a screw receiving channel, a channel adapted to hold sliding pins, a channel adapted to hold a pane and a channel adapted to fasten a compressible gasket to the element. Four such elements fastened together by means of screws form a rigid body surrounding the pane. The outside dimensions of this rigid body are slightly smaller than the inside dimensions of the window case in which it is adapted to be fitted. The rigid body is surrounded by a compressible gasket which is adapted to be compressed against the inside of the window case to form a seal therewith. The sliding pins are adapted to be slid into holes in the window case and to be locked in that position, thus providing a pivotal mounting for the supplemental window. The compressible gasket provides an effective weather and noise seal and holds the supplemental window in an open position when desired. The compressible gasket also compensates for irregularities in the linearity and dimensions of the window cases in which it is adapted to be fitted.

8 Claims, 6 Drawing Figures

SEALING FRAME FOR USE IN WINDOW CASE

FIELD OF THE INVENTION

This relates to pivotable self-sealing window frames adapted particularly for use with windows used to supplement existing windows in existing window cases.

BACKGROUND OF THE INVENTION

In the search for ways to better insulate windows, particularly of existing structures, it has been the practice to add new supplemental windows to the outside of the structure along with a new outer framing member surrounding the added window. The installation of such outside windows is of course difficult and laborious and the use of a new frame adds to its cost. Moreover such outside windows interfere with the use of the windows for ventilation purposes where the existing windows are opened by swinging outwardly. Suggestions have also been made for the addition of supplemental windows inside existing windows thereby providing more convenience of installation. However such supplemental windows are not adapted to provide a tight seal around a somewhat irregularly shaped window case, without the presence of an additional peripheral frame.

SUMMARY OF THE INVENTION

It is, therefore, an object of the present invention to provide a window which may be used with an existing rectangular (including a square) window case without the need of an added frame, is simple to install, provides an effective weather and noise seal, may be opened inwardly and will maintain itself in an open position. The present invention is particularly useful with existing windows which open outwardly.

In accordance with the invention there is provided a frame for installation in a rectangular window case having pin receiving means thereon, said frame comprising a substantially planar, rigid member, said rigid frame having an outer peripheral surface which is rectangular in cross-section, pivot pins mounted on said rigid member, a compressable gasket attached to said rigid member, said compressable gasket having an outer periphery which circumscribes the outer peripheral surface of said rigid member, said pivot pins being positioned in an axis which is parallel to the plane of the rigid member, said axis being parallel to and proximate to one side of said rigid member, said pins being adapted to be positioned in said pin receiving means associated with said window casing to permit pivotal movement of said frame about said axis whereby said frame may be positioned within said window case with said gasket under compression thereby to form a seal between said frame and said window case.

BRIEF DESCRIPTION OF THE DRAWINGS

In drawings which illustrate an embodiment of the invention:

FIG. 3(*b*) is a cross sectional view of the moulding shown in FIG. 3(*a*) with the gasket and window pane in position.

DETAILED DESCRIPTION OF THE DRAWINGS

Figure 1:
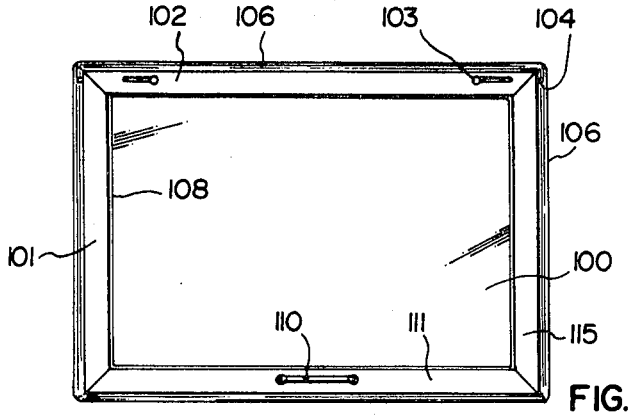
FIG. 1 is a plan view of a pivotable window frame in which a pane is mounted, in accordance with the invention.

Referring to FIG. 1, there is shown a pivotable window sealing frame comprising a rigid frame member having side elements 101 and 115 and top and bottom elements 102 and 111 respectively. In the embodiment illustrated, the elements 101, 115, 102 and 111 comprise a section of a linear aluminum extrusion, a cross section of which is illustrated generally as 200 in FIG. 3. It will be appreciated that instead of aluminum the frame may be composed of plastic. The ends of the strips of the elements are cut at 45° angles to provide the frame with right angled corners. The elements are of approximately ¾ inch in length less than the respective inside dimensions of the window case in which they are adapted to be mounted.

Figure 3A:
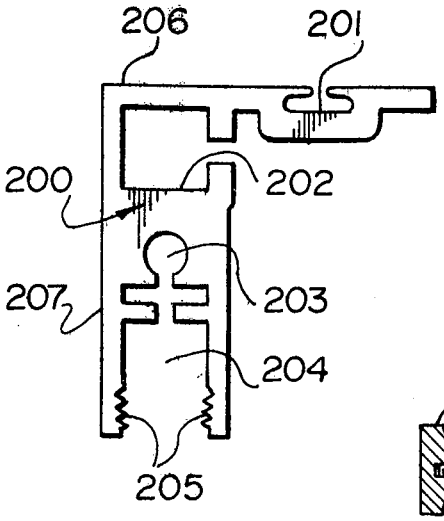
FIG. 3(*a*) is a cross sectional view of a moulding suitable for use in the window frame shown in FIG. 1.
Figure 3B:
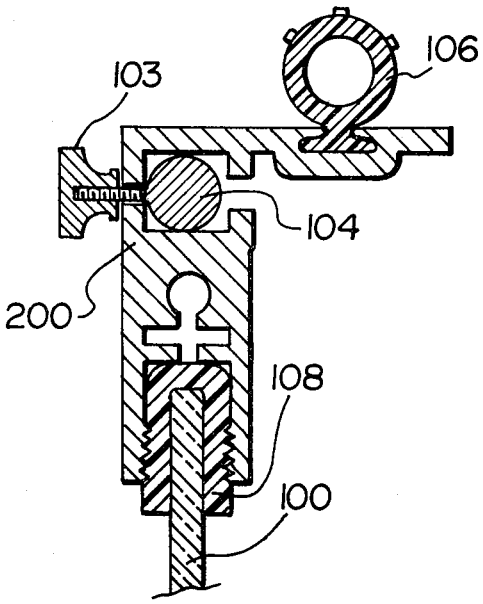

As shown in FIG. 3 the extrusion in cross section comprises a first arm having an outer surface 206 which is adapted to form the outer peripheral surface of the rigid member. The surface 206 has a recess 201 therein in the form of an elongated slot. Recess 201 is adapted to accommodate a T-shaped flange 402 on the compressable gasket 400 shown in FIG. 4.

The cross section of the extrusion includes a second arm situated at a right angle to the first arm having an outer surface 207 which is adapted to form the front surface on the rigid member. A recess 202 is situated between the two arms and is adapted to slidably hold bolt pin 104 therein. The second arm also includes a recess 203 of semi-circular cross section which is adapted to receive self-tapping screw 105 therein.

Also situated on the second arm of the moulding is a recess 204, which forms an elongated slot and is adapted to receive and maintain a glass or other pane therein.

Figure 2:
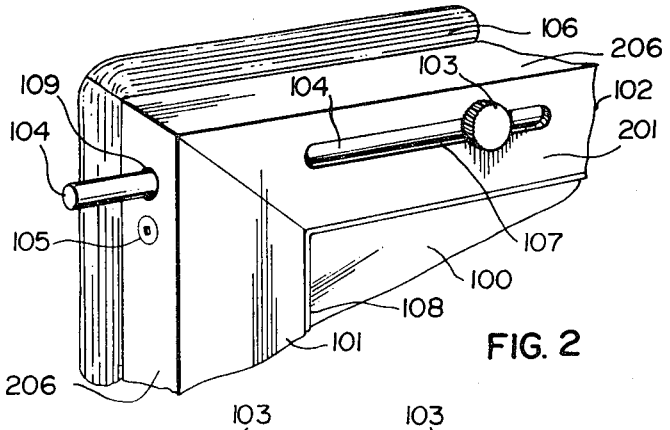
FIG. 2 is a perspective view in enlarged scale of the upper left hand corner of the window frame shown in FIG. 1.

Referring now to FIG. 2, at each end of the upper element 102 of the rigid member a slide bolt pin 104 is positioned in the elongated slot 202. An elongated opening 107 is situated in the wall of the slot 202 parallel to the slot through which a thumbscrew 103 attached to the pin 104 projects beyond the front surface 207 of the frame. By means of the thumbscrew 103, the slide pin may be moved back and forth in the longitudinal direction of slot 202. The pin may be locked in position at any point by tightening the thumbscrew 103.

As shown in FIG. 2, each pair of adjacent elements (such as 102 and 101) is held together by means of a screw 105 which is screwed into elements 101 and 102 during assembly in line with the central axis of the slot 203 in element 102, thereby tapping threads on the surface of slot 203.

Referring to FIG. 3(*b*), the elements are attached to the edges of the pane 100 by means of the slot 204. A U-shaped plastic gasket 108 situated between the pane and the element provides a tight fit and teeth 205 assist in preventing relative movement.

Figure 4:
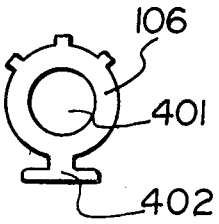
FIG. 4 is a cross sectional view of a gasket suitable for use in the window frame shown in FIG. 1.

Surrounding the peripheral edge 206 of the rigid member is a hollow gasket 106 composed of a flexible plastic, rubber or synthetic rubber material. As shown in FIG. 4, the gasket includes a T-shaped flange 402 which serves to anchor the gasket in slot 201 on the peripheral surface 206 of the rigid member. The strips of gasket attached to adjacent elements are joined at the corners in such a manner as to reduce the amount of gasket material at the corners in order to prevent bunching of the gasket when it is compressed. As shown in FIG. 2, this reduction of gasket material at the corners is achieved by cutting the gasket at angles less than 45° and joining the ends of the gasket. Preformed moulded corner gaskets may also be used to achieve this reduction. The ends of such corner gaskets would be sealed to the sides of the linear gaskets.

To install the window frame, a jig is placed successively against the two top inside surfaces 501 of the window case and a drill hole position is marked on each side of the window case. Holes large enough to accommodate the slide pins 104 are then drilled in each side of the window case in an axis parallel to the plane of the existing window. The line joining the centre of these two holes will form the axis about which the added window frame will pivot.

The slide pins 104 are placed at their innermost positions and the upper end of the window frame is positioned within the window case so that the axis of the slide pins corresponds to the axis of the two drilled holes. The slide pins 104 are then moved outwardly into the drilled holes in the window case 501 and they are both locked in the extreme outward position by tightening thumbscrews 103.

Figure 5:
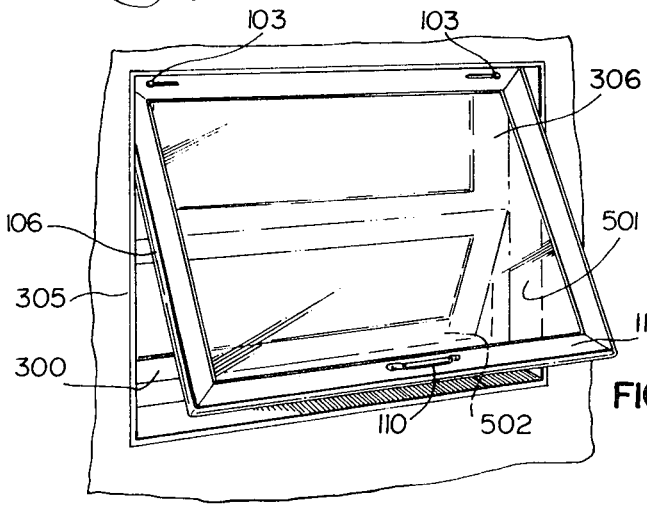
FIG. 5 which is shown on the first page of drawings is a perspective view of the window frame shown in FIG. 1 mounted in a window case and shown in an open position.

Because the outside dimensions of the window gasket are slightly greater than the inner dimensions of the window case, the gasket is compressed somewhat when the added window frame is fully positioned within the window case in accordance with the above. The static friction of the compressed gasket against the window case will permit the added window frame to remain in an ajar position as shown in FIG. 5 without further support or locking means, permitting the window 502 of the existing structure to be opened outwardly.

As will be appreciated from the foregoing the outer dimensions of the rigid member are slightly less than the inside dimensions of the window case and the outside dimension of the gasket are slightly greater than the inside dimensions of the window case. It has been found that compression of the gasket in an amount between 15 and 40% is possible and that compression between 25 and 33% is preferable.

Since the gasket may be compressed in a non-uniform manner along its length it automatically compensates for irregularities in the dimensions and linearity of the window case and thereby obviates the need for an outer frame attached to the window case.

It will also be appreciated that the frame, according to the present invention, may be used with added screens as well as supplemental storm windows and may also be used with the pivot axis in a vertical position to accommodate existing windows which pivot outwards on a vertical axis. In the latter case, a thick plastic washer is placed around the bottom hinge pin between the frame and the window sill in order to support the weight of the supplementary window.

The window may also include pins at the bottom thereof similar to the pivot pins at the top of the window which are adapted to be slid into holes in the bottom of the window case when the supplemental window is closed, in order to secure the window in the closed position.

What I claim as my invention is:

1. A frame for installation in a rectangular window case having pin receiving means thereon, said frame comprising a substantially planar rigid frame including four linear elements having first surfaces which together form an outer peripheral surface of said rigid frame which is rectangular, pivot pins mounted on said rigid frame, a compressible gasket attached to said linear elements, said compressible gasket being positioned adjacent said outer peripheral surface to provide an outer periphery which circumscribes the outer peripheral surface of said frame so that said gasket is adapted to be compressed between said outer peripheral surface and said window case when the window is closed, said pivot pins being positioned in an axis which is parallel to the plane of said frame and proximate to one side of said frame so that said frame is adapted to be mounted to permit it to be pivoted so that it may be positioned ajar of the window case, said pins being adapted to be positioned in said pin receiving means associated with said window case to permit pivotal movement of said frame about said axis whereby, when the window is open, the frame is held against movement by static frictional forces resulting from compression of portions of the gasket.

2. A frame according to claim 1 wherein said pivot pins are located at opposite ends of one of said elements, said pins being adapted to be slid outwardly into recesses in the window case and to be locked in place when so positioned.

3. A frame according to claim 1 wherein said elements include edges which form an inner periphery of said rigid member and means at said inner periphery to secure a pane in said frame.

4. A frame according to claim 1 wherein said elements are cut from a linear extrusion, said extrusion including a channel which is adapted to receive a screw and to permit the screw received therein to tap threads on the surface of said channel to thus hold the screw in place.

5. In combination with a window and a window case surrounding said window, a storm window comprising a frame within which a window pane is mounted, said frame comprising a rectangular rigid member including four linear elements fixedly positioned at right angles to one another, said elements having first surfaces which together form an outer peripheral surface of said frame, a compressible gasket mounted on said peripheral surface, said gasket being positioned adjacent said outer peripheral surface and being adapted to be compressed between said outer peripheral surface of said frame and said window case, pivot pins mounted on said frame and positioned in an axis which is parallel to the plane of the storm window, said axis being parallel to and proximate to one side of said frame, said pins being positioned in recesses in said window case to permit pivotal movement of said storm window about said axis, whereby when the window is open, the frame is held in position by static frictional forces resulting from compression of portions of the gasket.

6. The combination according to claim 5 wherein said pivot pins are located at opposite ends of one of said elements, said pivot pins being adapted to be slid outwardly into recesses in the window case and to be locked in place when so positioned.

7. The combination according to claim 5 wherein said elements include edges which form an inner periphery of said rigid member and means at said inner periphery to secure a pane in said frame.

8. The combination according to claim 5 wherein said elements are cut from a linear extrusion, said extrusion including a channel which is adapted to receive a screw and to permit the screw received therein to tap threads on the surface of said channel to thereby prevent the screw from withdrawing to thereby hold said elements together.

* * * * *